United States Patent [19]

Garsin

[11] Patent Number: 4,615,613

[45] Date of Patent: Oct. 7, 1986

[54] CHARGE PARTICLE REMOVAL DEVICE

[75] Inventor: Paul A. Garsin, Webster, N.Y.

[73] Assignee: Xerox Corporation, Stamford, Conn.

[21] Appl. No.: 720,443

[22] Filed: Apr. 5, 1985

[51] Int. Cl.[4] ..... G03G 21/00

[52] U.S. Cl. ..... 355/15; 430/125

[58] Field of Search ..... 355/15, 3 R; 15/256.52, 15/1.5; 430/125; 118/652

[56] References Cited

U.S. PATENT DOCUMENTS

| | | | |
|---|---|---|---|
| 3,572,923 | 3/1971 | Fisher et al. | 355/15 |
| 3,722,018 | 3/1973 | Fisher | 15/1.5 |
| 4,265,990 | 5/1981 | Stolka et al. | 430/59 |
| 4,533,236 | 8/1985 | Garsin | 355/15 |

*Primary Examiner*—R. L. Moses

*Attorney, Agent, or Firm*—Mark Costello

[57] ABSTRACT

Cleaning apparatus for removing residual toner particles from a charge retentive surface. The apparatus utilizes a cleaning brush to which an electrical bias is applied in order to enhance the toner removal. The brush has different biases applied thereto in accordance with the area of the charge retentive surface being cleaned. Thus, when toner is being removed from the document area of the charge retentive surface, one bias level is applied and when the interdocument area is being cleaned a different bias is applied thereby increasing the cleaning latitude.

7 Claims, 3 Drawing Figures

CHARGE PARTICLE REMOVAL DEVICE

Figure 1:
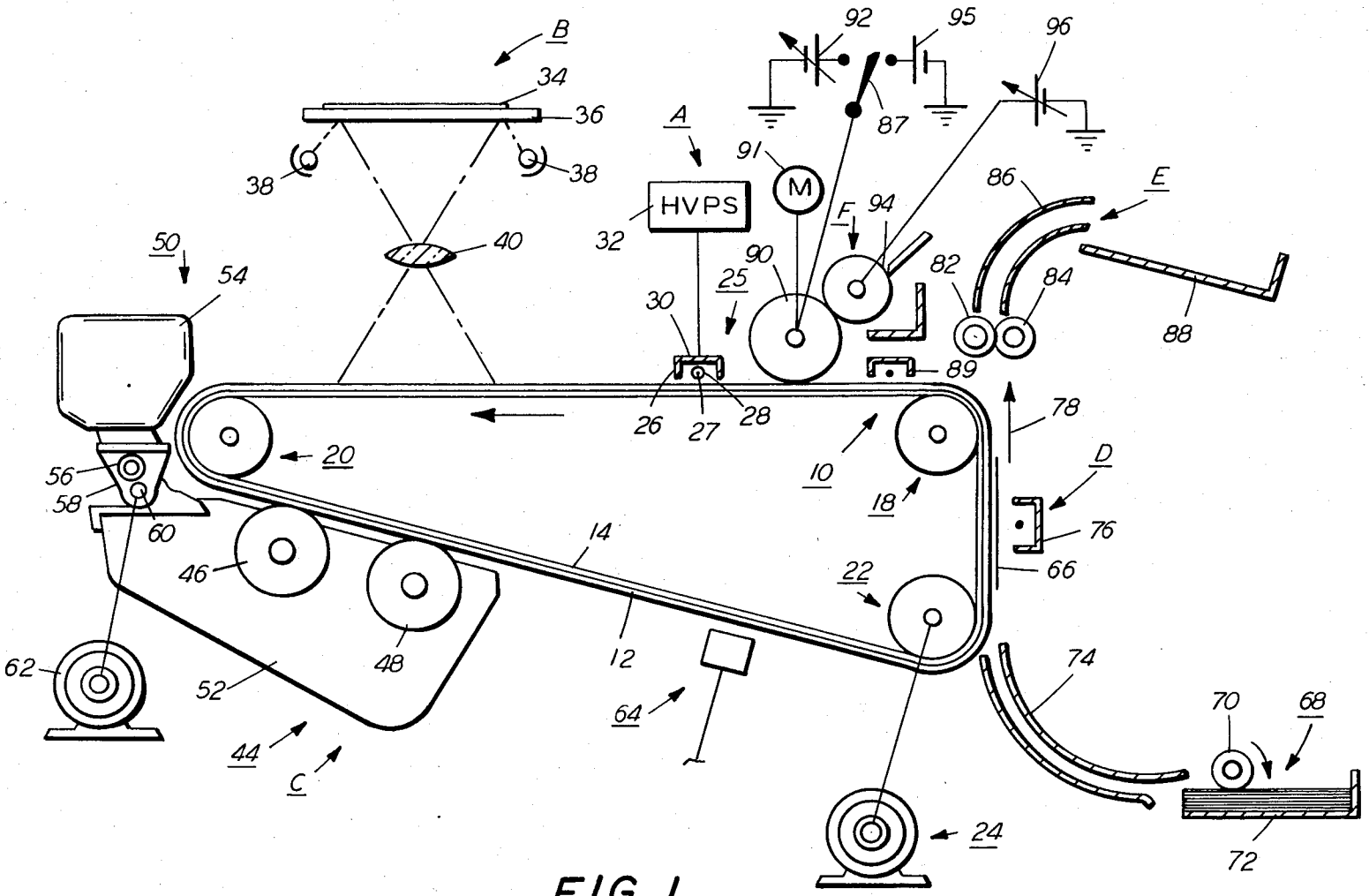

This invention relates generally to an electrophotographic printing machine, and more particularly to an improved cleaning system for use therein.

In electrophotographic printing, a charge retentive surface, for example, a photoconductive member or photoreceptor is uniformly charged to sensitize the surface thereof. The charged photoconductive member is exposed to a light image of an original document being reproduced. Exposure of the sensitized photoconductive surface discharges the charge selectively. This records an electrostatic latent image on the photoconductive surface corresponding to the informational areas contained within the original document being reproduced. Development of the electrostatic latent image recorded on the photoconductive surface is achieved by bringing a developer material into contact therewith. Typical developer materials comprise a heat settable plastic powder, known in the art as toner, which adheres triboelectrically to coarser carrier granules, for example, ferromagnetic granules. The toner particles are selected to have the appropriate charge relative to the electrostatic latent image recorded on the photoconductive surface. Thus, when the charge on the photoreceptor is negative the toner is charged positively. When the developer material is brought into contact with the latent electrostatic image on the photoconductive surface, the toner particles transfer from the carrier granules to the electrostatic latent image. This forms a powder image on the photoconductive surface.

The toner image on a reusable photoconductive surface is subsequently transferred to a sheet of support material such as plain paper. All of the toner forming the images does not transfer to the sheet. The toner remaining on the photoconductive surface which is referred to as residual toner must be removed from the photoconductive surface otherwise subsequent image formation will be adversely affected.

Heretofore, various devices such as blades, foam rollers, conductive brushes, non-conductive brushes and magnetic brushes have been employed for toner removal from the photoreceptor.

It has been found that establishing an electrostatic field between the photoreceptor and a cleaning member such as a fiber brush or a magnetic brush enhances toner removal from the photoreceptor. Such arrangements are disclosed in U.S. Pat. Nos. 3,572,923 and 3,722,018 granted to Fisher et al. on Mar. 22, 1973, and Fisher on Mar. 30, 1971, respectively. Likewise, when an electrostatic field is established between the brush and a brush detoning member removal of toner from the brush is improved. The creation of the electrostatic field between the brush and photoreceptor may be accomplished by applying a d.c. voltage to the brush. The field established between the brush an the insulative photoreceptor is such that the toner on the photoreceptor is attracted to the brush. Thus, if the toner on the photoreceptor is negatively charged then the aforementioned field would be less negative relative to the charge on the toner.

The cleaning performance of an electrostatic cleaner depends largely on the QE condition that prevails in the nip. The Q is the charge state of the residual toner entering the cleaner and the E is the electric field imposed on the toner particle. The electric field that prevails in the nip is determined by the applied brush bias and the photoreceptor potential. The photoreceptor potential at the nip entrance can be different for the document area and the interdocument area and thus the field established in a document zone and in an interdocument zone can be very different.

An approach which accomodates the foregoing situation is to set the cleaning brush bias such that it satisfies the electrostatic field in the document zone as well as the field in the interdocument zone. That is, a single brush bias is chosen that resides within the cleaning latitude for the document zone as well as the interdocument zone. This approach is unsatisfactory because the area of overlap between the two regions is small at time zero and completely disappears as the material ages.

In accordance with the present invention, the cleaning latitude of the document and the interdocument zones are increased by applying different biases to the brush for the two zones. A switch arrangement is provided for changing the cleaning brush bias in accordance with the area or zone (i.e., document or interdocument) of the charge retentive surface being cleaned. To this end, there is provided a switch for selectively converting the brush to one or the other of two potential sources in order to effect the proper brush bias.

Figure 2:
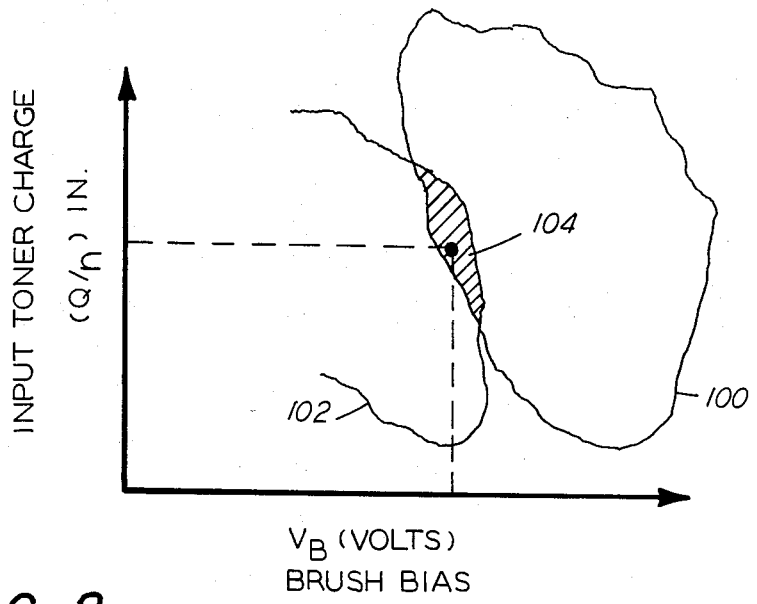
Figure 3:
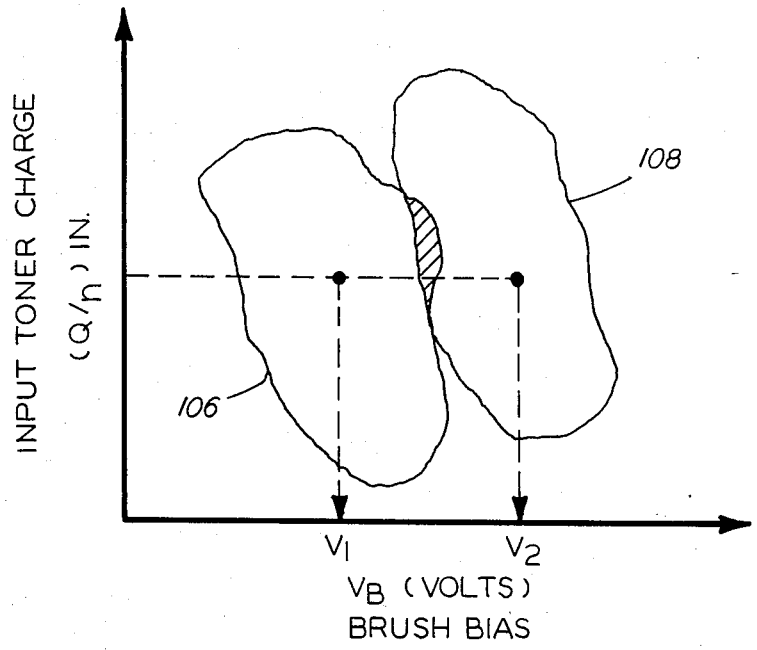

Other aspects of the present invention will become apparent as the following description proceeds with reference to the drawings, in which:

FIG. 1 is a schematic elevational view of an electrophotographic machine incorporating the features of the present invention therein; and FIG. 2 is a plot of charge on toner entering the cleaning nip versus cleaning brush potential for the document and interdocument areas of a prior art device; and FIG. 3 is a plot of charge on toner entering the cleaning nip versus cleaning brush potential for the document and interdocument areas of the present invention.

For a general understanding of the features of the present invention, a description thereof will be made with reference to the drawings. FIG. 1 schematically depicts the various components of an illustrative electrophotographic printing machine and cleaning apparatus incorporating the apparatus and method of the present invention.

Inasmuch as the art of electrophotographic printing is well known, the various processing stations employed in the printing machine illustrated in FIG. 1 will be described briefly.

As shown in FIG. 1, the printing machine utilizes a photoconductive belt 10 which consists of an electrically conductive substrate 14, a charge generator layer 12 comprising photoconductive particles randomly dispersed in an electrically insulating organic resin and a charge transport electrically inactive polycarbonate resin having dissolved therein one or more diamines. A photoreceptor of this type is disclosed in U.S. Pat. No. 4,265,990 issued May 5, 1981 in the name of Milan Stolka et al., the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device indicated generally by the reference numeral 25, charges the belt 10 to a relatively high, substantially uniform negative potential. A suitable corona generating device for negatively charging the photoconductive belt 10 comprises a conductive shield 26 and a dicorotron electrode comprising an elongated bare wire 27 and a relatively thick electrically insulating layer 28 having a thickness which precludes a net d.c. corona current when an a.c. voltage is applied to the corona wire and when the shield and the photoconductive surface are at the same potential. Stated differently, in the absence of an external field supplied by either a bias applied to the shield or a charge on the photoreceptor there is substantially no net d.c. current flow.

Next, the charged portion of photoconductive surface is advanced through exposure station B. At exposure station B, an original document 34 is positioned facedown upon a transparent platen 36. Lamps 38 flash light rays onto original document 34. The light rays reflected from the original document 34 are transmitted through lens 40 forming a light image thereof. Lens 40 focuses the light image onto the charged portion of photoconductive surface 12 to selectively dissipate the charge thereon. This records an electrostatic latent image on photoconductive surface 12 which corresponds to the informational areas contained within original document 34.

At development station C, a magnetic brush development system, indicated generally by the reference numeral 44 advances a developer material into contact with the electrostatic latent image and the test areas. Preferably, magnetic brush development system 44 includes two magnetic brush developer rollers 46 and 48. These rollers each advance the developer material into contact wih the latent image. Each developer roller forms a brush comprising carrier granules and toner particles. The latent image attracts the toner particles from the carrier granules forming a toner powder image on the latent image. As successive electrostatic latent images are developed, toner particles are depleted from the developer material. A toner particle dispenser, indicated generally by the reference numeral 50, is arranged to furnish additional toner particles to housing 52 for subsequent use by developer rollers 46 and 48 respectively. Toner dispenser 50 includes a container 54 storing a supply of toner particles therein. A foam roller 56 disposed in a sump 58 coupled to container 54 dispenses toner particles into an auger 60. Auger 60 comprises a helical spring mounted in a tube having a plurality of apertures therein. Motor 62 rotates the helical member of auger to advance the toner particles through the tube 30 that toner particles are disposed from the apertures thereof.

A sheet of support material 66 is moved into contact with the toner powder image at transfer station D. The sheet of support material is advanced to transfer station D by sheet feeding apparatus 68. Preferably, sheet feeding apparatus 68 includes a feed roll 70 contacting the uppermost sheet of stack 72. Feed rolls 70 rotate so as to advance the uppermost sheet from stack 72 into chute 74. Chute 74 directs the advancing sheet of support material into contact with photoconductive surface 12 of belt 10 in a timed sequence so that the toner powder image developed thereon contacts the advancing sheet of support material at transfer station D.

Transfer station D includes a corona generating device 76 which sprays negative ions onto the backside of sheet 66. This attracts the positively charged toner powder image from photoconductive surface 12 to sheet 66. After transfer, the sheet continues to move, in the direction of arrow 78, onto a conveyor (not shown) which advances the sheet of fusing station E.

Fusing station E includes a fuser assembly, indicated generally by the reference numeral 80, which permanently affixes the transferred powder image to sheet 66. Preferably, fuser assembly 80 comprises a heated fuser roller 82 and a back-up roller 84. Sheet 66 passes between fuser roller 82 and back-up roller 84 with the toner powder image contacting fuser roller 82. In this manner, the toner powder image is permanently affixed to sheet 66. After fusing, chute 86 guides the advancing sheet 66 to catch tray 88 for subsequent removal from the printing machine by the operator.

After the sheet of support material is separated from photoconductive suface of belt 10, the residual toner particles to photoconductive surface are removed therefrom. These particles are removed from photoconductive surface at cleaning station F. Prior to the toner to be removed at the cleaning station F, it moves past a preclean dicorotron 89. The preclean dicorotron generates positive ions which serve to charge the toner positively.

At cleaning station F, there is a magnetic brush 90. The brush 90 is supported for rotation in contact with the photoconductive surface, a motor 91 being provided for effecting rotation. A first source 92 of d.c. potential is operatively connected to the brush 90 via a switch 87 such that an electrostatic field is established between the insulative member 10 and the brush to thereby cause attraction of the charged toner particles from the surface 10. The applied voltage is preferably equal to approximately 220 volts. It has been observed that when the brush is biased at the aforementioned voltage, the cleaning latitude is such that satisfactory removal of residual toner from the area that contained the developed image is achieved. A second source 95 of d.c. potential is operatively connected to the brush 90 via the switch 87. The voltage applied to the brush from the source 95 is preferably in the order of 130 to 200 volts. When the brush is biased in the order of 130 to 200 volts, the cleaning latitude is such that safisfactory removal of residual toner from the interdocument areas or zones is accomplished.

The manipulation of the switch in order to alternately connect the power sources 92 and 95 to the brush 90 in accordance with the area of the member 10 being contacted changes the biasing of the brush. Thus, when an image is being contacted,the brush is connected to the source 95 and when the interdocument area is being contacted, the switch is actuated to connect the source 92 to the brush. Such actuation of the switch can be affected automatically by the employment of control techniques well known in the art. For example, timing holes (not shown) provided in the belt can be sensed and used to generate a timing signal which corresponds to the belt position relative to the brush 90 at any given time. Therefore, when the signal represents the document area being contacted by the brush the switch 87 is adapted to be placed in contact with the source 92 and with the source 96 when the brush is in contact interdocument area with source 95.

An insulative detoning roll 94 is supported for rotation in contact with the conductive brush 90 and at twice the speed of the brush. A source of d.c. voltage 96 electrically biases the roll 94 to the same polarity as the brush 90 is biased. However, the magnitude of this bias is greater than the bias applied to the brush. For example, a suitable bias is equal to approximately 400 volts. Preferably the roll 92 is fabricated from anodized aluminum whereby the surface of the roll contains an oxide layer of about 20 to 30 microns and is capable of leaking charge to preclude excessive charge build-up on the detoning roll. The roll 90 is supported for rotation by a motor 93.

A scraper blade 98 contacts the roll 94 for removing the toner therefrom and causing it to fall into a collector 100.

As noted hereinabove, the cleaning performance of an electrostatic cleaner depends largely on the QE condition that prevails in the nip. The Q is the charge state of the residual toner entering the cleaner and the E is the electric field imposed on the toner particle. The electric field that prevails in the nip is determined by the applied brush bias and the photoreceptor potential. The photoreceptor potential at the nip entrance can be different for the document area and the interdocument area and thus the field estabished in a document zone and in an interdocument zone can be very different.

The present approach to accommodate the foregoing situation is to set the cleaning brush bias such that it satisfies the field in the document zone as well as the field in the interdocument zone. That is, a brush bias is chosen that resides within the cleaning latitude for the document zone as well as the interdocument zone. This approach is unsatisfactory because the area of overlap between the two regions is small at time zero and completely disappears as the material ages.

The small cleaning latitude noted above is illustrated in FIG. 2. Depicted therein is a plot of input toner charge versus brush bias. An interdocument area is indicated by reference character 100 while a document area is indicated by reference character 102. The area 100 corresponds to toner input charge and brush bias conditions for which satisfactory cleaning of the interdocument area is obtained. The area 102 corresponds to toner input charge and brush bias conditions for which satisfactory cleaning of the document area is obtained. The overlapping area designated by reference character 104 corresponds to input toner charge and brush bias conditions for which satisfactory cleaning of both the document and interdocument is obtained. As can be seen from the area 104, the cleaning latitude is quite narrow when the cleaning brush bias is set at a single voltage.

In accordance with the present invention, the cleaning latitude of the document and interdocument zones are increased by the provision of the switch arrangement 87 for changing the cleaning brush bias in accordance with the area of the charge retentive surface being cleaned. To this end, the switch 87 is used for selectively connecting the brush 90 to one or the other of the two potential sources 92 or 95 in order to effect the proper brush bias.

As viewed in FIG. 3, a cleaning zone represented by reference character 106 corresponds to the document cleaning zone capability when the brush bias represented by $V_1$ is set to approximately −220 volts. Reference character 108 represents the interdocument cleaning zone capability when the brush bias is approximately −320 volts, the exact voltages depending upon the particular imaging process configuration in which this cleaning system is employed. For example, for another machine configuration, it was found that acceptable document and interdocument cleaning was obtained when the brush bias during document zone cleaning was more negative than the brush bias setting for interdocument zone cleaning.

Unlike the case of the single brush bias, the cleaning latitude is not defind by the overlap between the areas 106 and 108. The cleaning latitude for each brush bias illustrated in FIG. 3 is the entire area 106 in the case of document zone cleaning and the entire area 108 in the case of interdocument cleaning.

I claim:

1. Method of removing toner from a charge retentive surface with areas having different charge levels, said method comprising the steps of:

moving a charge retentive surface having successive document areas and interdocument areas thereon in an endless path;

contacting said charge retentive surface with a cleaning structure;

electrically biasing said cleaning structure at a first predetermined bias level while said cleaning structure is in contact with a document area of said charge retentive surface; and electrically biasing said cleaning structure to a second predetermined bias level while said cleaning structure is in contact with an interdocument area of said charge retentive surface.

2. Apparatus for removing residual toner from a charge retentive surface, said apparatus comprising:

a cleaning member;

means for moving a charge retentive surface past said cleaning member whereby document areas and interdocument areas of said surface move therepast; and means for applying either of a first and second predetermined voltage bias to said cleaning member in accordance with the movement of said document and interdocument areas past said cleaning member.

3. Apparatus according to claim 2 wherein said first voltage bias is more positive than said second voltage bias.

4. Apparatus according to claim 3 wherein said first voltage bias is approximatley equal to −220 volts d.c. and said second voltage bias is approximately equal to −320 volts d.c.

5. Apparatus according to claim 3 wherein said cleaning member comprises a magnetic brush.

6. The method according to claim 1 wherein said first bias level is more positive than said second bias level.

7. The method according to claim 6 wherein said first bias level is approximately −220 volts d.c. an said second bias level is approximately equal to −320 volts d.c.

* * * * *